US006328590B1

(12) United States Patent
Linnell

(10) Patent No.: US 6,328,590 B1
(45) Date of Patent: Dec. 11, 2001

(54) METHODS AND APPARATUS FOR CONTROLLING ATTACHMENT OF AN ELECTRONIC MODULE WITH A CIRCUIT BOARD CONNECTOR

(75) Inventor: Thomas E. Linnell, Northborough, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 09/620,491

(22) Filed: Jul. 20, 2000

(51) Int. Cl.[7] ..... H01R 13/627; H01R 24/00; H01R 12/00

(52) U.S. Cl. ..... 439/352; 439/630; 439/79

(58) Field of Search ..... 439/354, 357, 439/358, 630, 650, 352, 79

(56) References Cited

U.S. PATENT DOCUMENTS

| | | | | |
|---|---|---|---|---|
| 4,370,013 | * | 1/1983 | Niitsu et al. | 439/352 |
| 5,236,373 | * | 8/1993 | Kennedy | 439/347 |
| 5,308,621 | * | 5/1994 | Kightlinger | 439/358 |
| 5,342,215 | * | 8/1994 | Silbernagel et al. | 439/357 |
| 5,762,514 | * | 6/1998 | Long et al. | 439/358 |
| 5,775,931 | * | 7/1998 | Jones | 439/358 |
| 5,921,808 | * | 7/1999 | Haftmann et al. | 439/495 |
| 6,056,579 | * | 5/2000 | Richards, III et al. | 439/358 |
| 6,132,231 | * | 10/2000 | Suzuki | 439/352 |

* cited by examiner

*Primary Examiner*—Gary Paumen
*Assistant Examiner*—Edwin A. León
(74) *Attorney, Agent, or Firm*—Chapin & Huang, L.L.C.; David E. Huang

(57) ABSTRACT

The invention is directed to techniques for controlling attachment of an electronic module (e.g., an IC) with a circuit board using a latching mechanism that requires a tool to de-latch the electronic module. As such, circuit board manufacturers can remove electronic modules from circuit board assemblies at customer sites, and prevent customers from removing the electronic modules themselves. One arrangement of the invention is directed to a technique for controlling attachment of an electronic module with a circuit board connector mounted on a circuit board. The electronic module has (i) a module housing, (ii) a module connector and (iii) an electronic circuit which is housed within the module housing and which is electrically coupled to the module connector. The technique involves positioning the module connector of the electronic module to face the circuit board connector, and moving the module connector toward the circuit board connector such that the module connector electrically connects to the circuit board connector. The technique further involves latching the module housing of the electronic module and the circuit board connector together using a latch mechanism having a concealed actuator that requires indirect access using a tool to de-latch the module housing from the circuit board connector. Such a requirement deters those without the tool (e.g., customers) from de-latching the module from the circuit board assembly, i.e., from removing the module and/or reconfiguring the circuit board assembly.

27 Claims, 8 Drawing Sheets

METHODS AND APPARATUS FOR CONTROLLING ATTACHMENT OF AN ELECTRONIC MODULE WITH A CIRCUIT BOARD CONNECTOR

BACKGROUND OF THE INVENTION

A typical circuit board includes layers of non-conductive material (e.g., fiberglass) and conductive material (e.g., metallic etching, metallic power supply planes, etc.). In general, circuit board components such as integrated circuits (ICs), resistors, capacitors and connectors fasten to mounting locations on the circuit board, and electrically communicate through the conductive material.

Circuit board manufacturers typically attach circuit board components to circuit boards using either a soldering approach or a press-fit approach. In the soldering approach, a circuit board manufacturer hard-mounts or solders electrical contacts (e.g., pins, pads, etc.) of a circuit board component to corresponding electrical contacts (e.g., plated-through holes or vias, pads, etc.) on a circuit board. There are a number of soldering technologies available to circuit board manufacturers including wave soldering, ball-grid array (BGA) mounting, etc.

In the press-fit approach, the circuit board manufacturer inserts pins of a circuit board component (e.g., an IC) into vias of a circuit board such that the pins and the vias form a compression fit. The press-fit component can then be removed and/or replaced. It is common for a circuit board manufacturer to manufacture circuit boards having both soldered and press-fit components.

SUMMARY OF THE INVENTION

Unfortunately, there are deficiencies in both the conventional soldering and press-fit approaches to attaching circuit board components to circuit boards. For example, in the soldering approach, a technician responding to a field service call at a customer site may determine that replacement of a soldered circuit board component is warranted (e.g., a defective IC, a required configuration change, etc.). Since the component is soldered to the circuit board, the technician must replace the entire circuit board. If the technician does not have another circuit board readily available, the technician typically must place an order for a new circuit board and make another service visit to the customer site when the new circuit board becomes available. In either situation (requiring technician to stock new circuit boards, or requiring technicians to place orders and make return visits), the task of servicing the customer can be substantially expensive.

Once the technician has replaced an original circuit board with a new circuit board, the technician typically returns the original circuit board to the manufacturer. If the original circuit board still operates properly, the circuit board may be reused elsewhere. However, if the original circuit board operates improperly due to a defective soldered circuit board component, the original circuit board must then be reworked, salvaged or scrapped.

In the press-fit approach, the technician can simply replace a press-fit circuit board component at the customer site (e.g., in order to change a configuration, replace a defective IC, etc.) if a new component is readily available. However, customers can remove and/or replace press-fit circuit board components as well. Accordingly, a circuit board manufacturer under contract to support or service a circuit board at a particular customer site may encounter service calls resulting from customers attempting to replace press-fit circuit board components themselves (e.g., to upgrade or change a circuit board configuration). Such customer tampering often results in damage to the circuit board or formation of an improper configuration of the circuit board under contract.

In an attempt to prevent customer tampering of circuit boards, a manufacturer can solder all circuit board components to the circuit boards when making the circuit board. However, by doing so, the manufacturer loses the ability to replace press-fit circuit board components at the customer site. Furthermore, if the circuit board is capable of receiving a variety of different components at a particular mounting location (e.g., a variety of interface ICs), the manufacturer using the soldering approach will be inclined to avoid manufacturing such circuit boards (i.e., soldering components) until it has received a formal customer order for fear of manufacturing too many circuit boards with unpopular component choices, thus promoting manufacturing delays and prohibiting the manufacturer from manufacturing in larger quantities for better economies of scale.

In contrast to the above-described conventional approaches to attaching circuit board components to circuit boards, the invention is directed to techniques for controlling attachment of an electronic module (e.g., an IC) with a circuit board using a latching mechanism that requires a tool to de-latch the electronic module. As such, circuit board manufacturers can remove electronic modules from circuit board assemblies at customer sites, while preventing customers from removing the electronic modules themselves. Such selective use of the latching mechanism may provide the manufacturer with flexibility in enforcing non-tampering policies.

One arrangement of the invention is directed to a technique for controlling attachment of an electronic module with a circuit board connector mounted on a circuit board. The electronic module has (i) a module housing, (ii) a module connector and (iii) an electronic circuit which is housed within the module housing and which is electrically coupled to the module connector. The technique involves positioning the module connector of the electronic module to face the circuit board connector, and moving the module connector toward the circuit board connector such that the module connector electrically connects to the circuit board connector. The technique further involves latching the module housing of the electronic module and the circuit board connector together using a latch mechanism having a concealed actuator that requires indirect access using a tool to de-latch the module housing from the circuit board connector. Such a requirement deters those without the tool (e.g., customers) from de-latching the module from the circuit board assembly, i.e., from removing the module and/or reconfiguring the circuit board assembly.

In one arrangement, the circuit board defines a hole, and de-latching the module housing from the circuit board connector involves inserting the tool through the hole defined by the circuit board to actuate (e.g., to depress) the concealed actuator. In this arrangement, items that cannot insert through the circuit board hole (e.g., items that are too big to fit through the hole) cannot actuate the concealed actuator thus deterring customers without the tool from tampering with the circuit board.

In one arrangement, latching the module housing and the circuit board connector together involves applying, as the latch mechanism, a clip assembly around at least a portion of the module housing and at least a portion of the circuit board connector to latch the module housing and the circuit board connector together. This use of the clip assembly enables selective or discretionary latching. Accordingly, a circuit board having a module housing connected to a circuit board connector without the clip assembly enables removal of the module housing from the circuit board connector without the use of the tool (e.g., removal by a customer). However, a circuit board having the module housing latched to the circuit board connector using the clip assembly requires the tool for removal of the module housing from the circuit board connector.

In one arrangement, the clip assembly includes a clip, as the concealed actuator, and a clip housing which covers a portion of the clip and which defines a hole. In this arrangement, de-latching the module housing from the circuit board connector involves inserting the tool through the hole defined by the clip housing to actuate the clip. Accordingly, items that cannot insert through the circuit board hole cannot actuate the concealed actuator thus deterring customers without the tool from tampering with the circuit board.

In one arrangement, the electronic circuit of the electronic module includes memory which stores data defining operation of the electronic module while the electronic module is attached to the circuit board connector. In this arrangement, a technician can de-latch the electronic module from the circuit board connector (e.g., using the tool) to access the data stored in the memory while the electronic module is disconnected from the circuit board connector. Accordingly, the technician can retrieve information such as dates of testing, test results, and bit error rates from modules which have been removed from circuit boards.

The features of the invention, as described above, may be employed in data storage systems, devices and methods and other computer-related components such as those manufactured by EMC Corporation of Hopkinton, Mass.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The invention is directed to techniques for controlling attachment of an electronic module (e.g., an IC) with a circuit board using a latching mechanism that requires a tool to de-latch the electronic module. As such, circuit board manufacturers can remove electronic modules from circuit board assemblies at customer sites, and prevent customers from removing the electronic modules themselves. The techniques of the invention may be used in data storage systems and apparatus, and in other computer-related devices such as those manufactured by EMC Corporation of Hopkinton, Mass.

Figure 1:
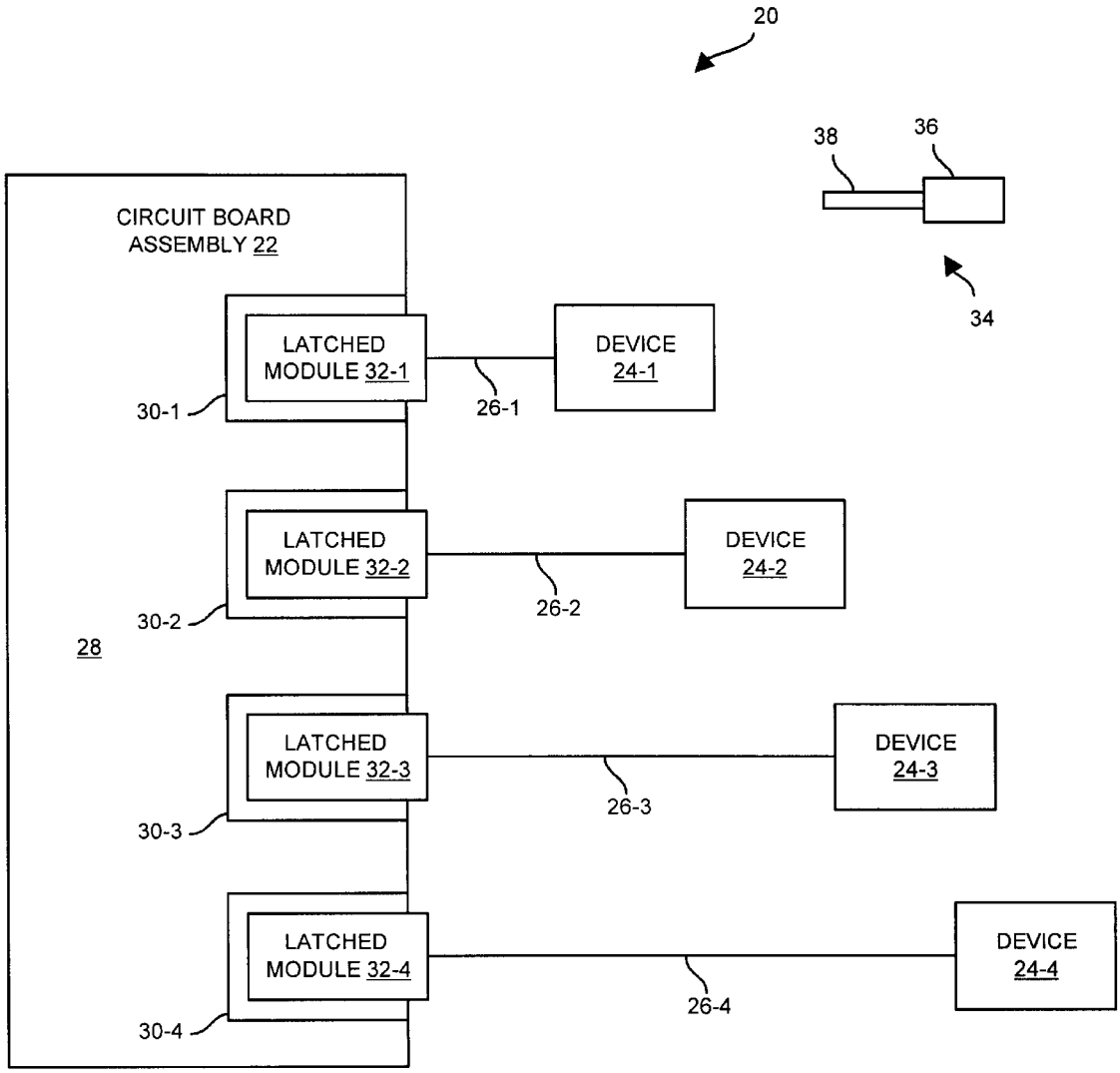
FIG. 1 is a block diagram of a connection system which is suitable for use by the invention.

FIG. 1 shows a connection system 20 which is suitable for use by the invention. The connection system 20 includes a circuit board assembly 22, multiple devices 24-1, . . . , 24-4(collectively, devices 24), and connecting media 26-1, . . . , 26-4 (collectively, connecting media 26). The circuit board assembly 22 includes a circuit board 28, multiple circuit board connectors 30-1, . . . , 30-4 (collectively, circuit board connectors 30), and multiple latched modules 32-1, . . . , 32-4 (collectively, modules 32). Preferably, the circuit board connectors 30 are hard mounted (e.g., soldered) to the circuit board 28. In contrast, the modules 32 are latched (e.g., plugged-in) to the circuit board connectors 30, and can be de-latched (e.g., unplugged) from the circuit board connectors 30 using a tool 34. The tool 34 includes a handle 36 and an actuating portion 38.

By way of example only, the circuit board 28 operates as an interface to the devices 24. As shown in FIG. 1, the length of each connecting medium 26 varies thus affecting the type of each module 32 (e.g., electrical/optical converters having a standard form factor but different operating speeds). Rather than manufacture and stock an inventory of circuit board assemblies 22 having numerous permutations of different module types, the manufacturer can create one type of circuit board 28 with hard mounted circuit board connectors 30, and form customized circuit board assemblies 22 by latching combinations of different module types to the connectors 30. The manufacture need not worry about customers tampering with the circuit boards assemblies 22 (e.g., removing or replacing the modules 32 to reconfigure the circuit board assemblies) by supplying only its technicians (service people trained to visit and service circuit board assemblies 22 at customer sites) with the tool 34 for de-latching the modules 32. Furthermore, in response to field service calls for improperly operating circuit board assemblies 22, the manufacturer may be able to replace modules 32 at the customer site rather than replace entire circuit board assemblies 28. Accordingly, the circuit board assembly 22 is easy to customize/configure, easy to repair, but is capable of preventing or deterring others from tampering. As will now be described with reference to FIG. 2, the tool 34 actuates a latch mechanism having a concealed actuator when de-latching a module 32 (e.g., module 32-2) from a corresponding circuit board connector 30 (e.g., connector 30-2).

Figure 2:
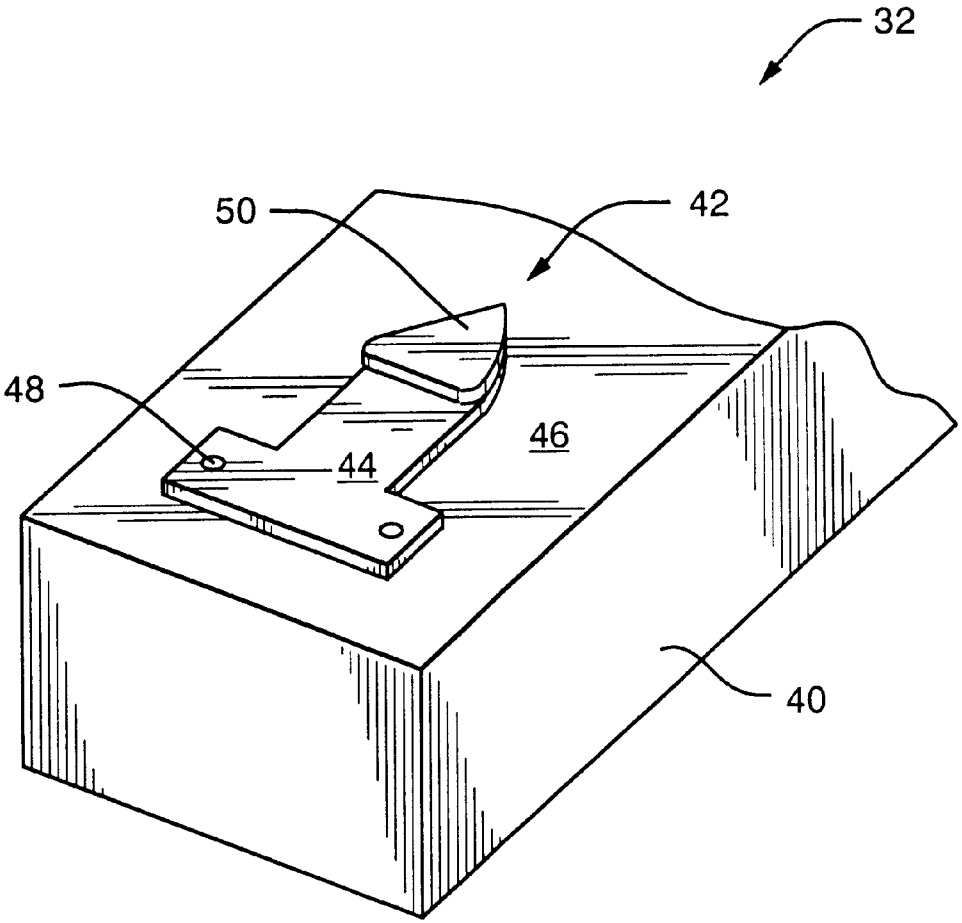
FIG. 2 is a perspective view of a portion of an electronic module which is latched to a circuit board connector of the connection system of FIG. 1.

As shown in FIG. 2, a module 32 includes a module housing 40, and a latch mechanism 42 for controlling attachment of the module 32 with the circuit board connector 30. The latch mechanism 42 has an actuator 44 which is fastened to the bottom-side surface 46 of the module 32 by hardware 48 (e.g., screws, rivots, etc.). The actuator 44 includes a tabbed portion 50 which is movable relative to the module 32. In particular, the tabbed portion 50 is flexible relative to the bottom-side surface 46 of the module 32 and, when moved toward the bottom-side surface 46 of the module 32, provides a spring action in the opposite direction. Accordingly, if a force is applied to the tabbed portion 50 to move the tabbed portion 50 toward the bottom-side surface 46 of the module 32, the tabbed portion 50 returns to its original position when the force is removed. Further details of the connection system 20 will now be provided with reference to FIG. 3.

Figure 3:
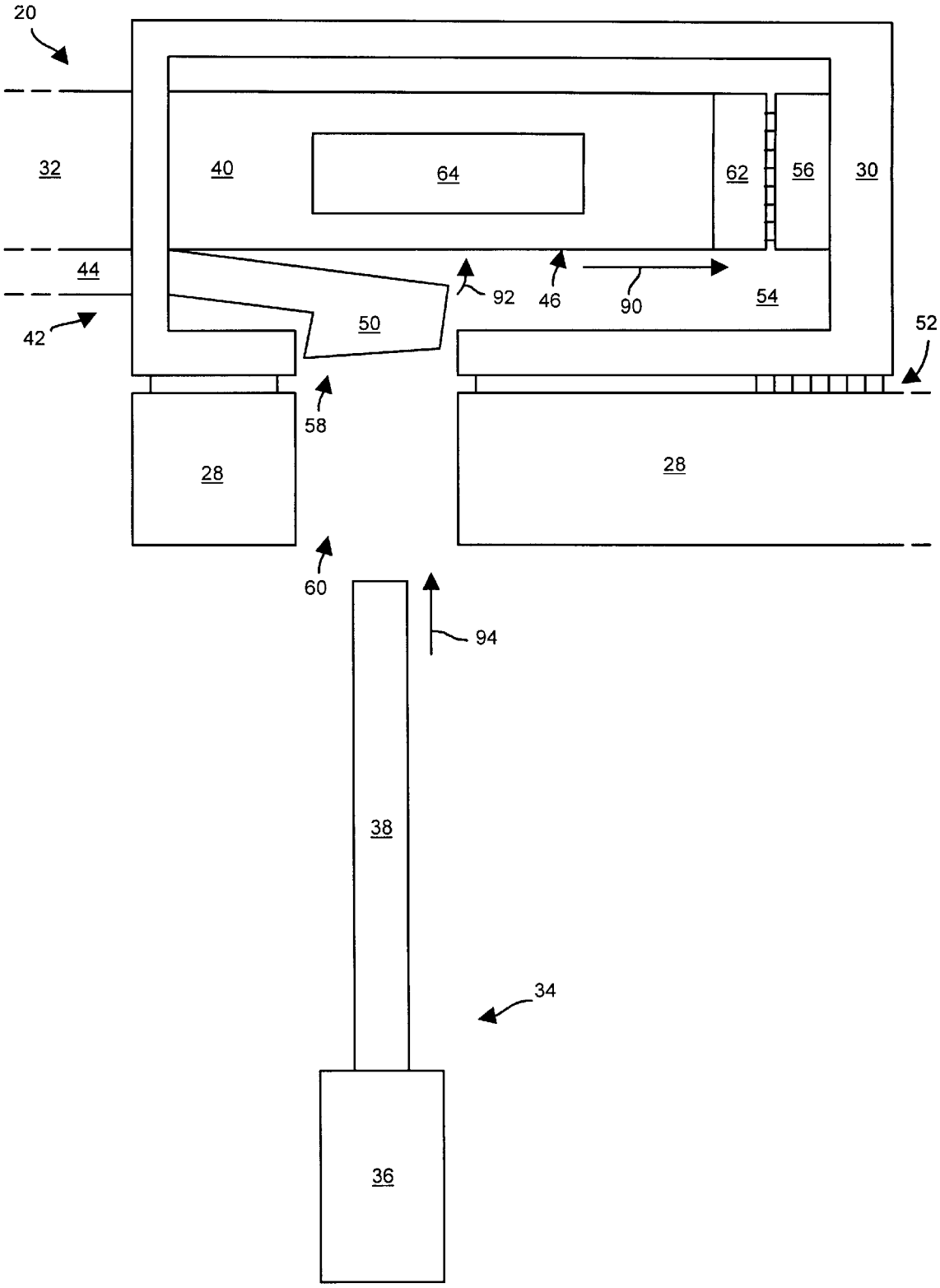
FIG. 3 is a side view of a portion of the electronic module of FIG. 2 when latched to the circuit board connector of the connection system of FIG. 1.

FIG. 3 shows a side view of the system 20. The circuit board connector 30 preferably mounts to the circuit board 28 via soldered joints 52 which provide (i) physical support for the circuit board connector 30, as well as (ii) electrical pathways between the circuit board connector 30 and the circuit board 28. The circuit board connector 30 includes a cavity 54 which is capable of receiving the module housing 40 of the module 32, and a connecting region 56 (e.g., an area of contacts, pads, pins, etc.). The circuit board connector 30 defines a hole 58 which is capable of aligning with and engaging the tabbed portion 50 of the actuator 44 (also see FIG. 2).

The circuit board 28 defines a hole 60 which aligns with the hole 58. The holes 58, 60 are capable of receiving an end of the actuating portion 38 of the tool 34.

The module 32 includes a module connector 62 (contacts, pads, pins, etc.) which is configured to engage with the connecting region 56 of the circuit board connector 30 when the module 32 attaches to the circuit board connector 30. The module 32 further includes an electronic circuit 64 which is housed within the module housing 40. The electronic circuit 64 electrically communicates with other circuit board components through the circuit board connector 30 and the circuit board 28 when the module 32 attaches to the circuit board connector 30. Further details of the electronic circuit 64 will now be provided with reference to FIG. 4.

Figure 4:
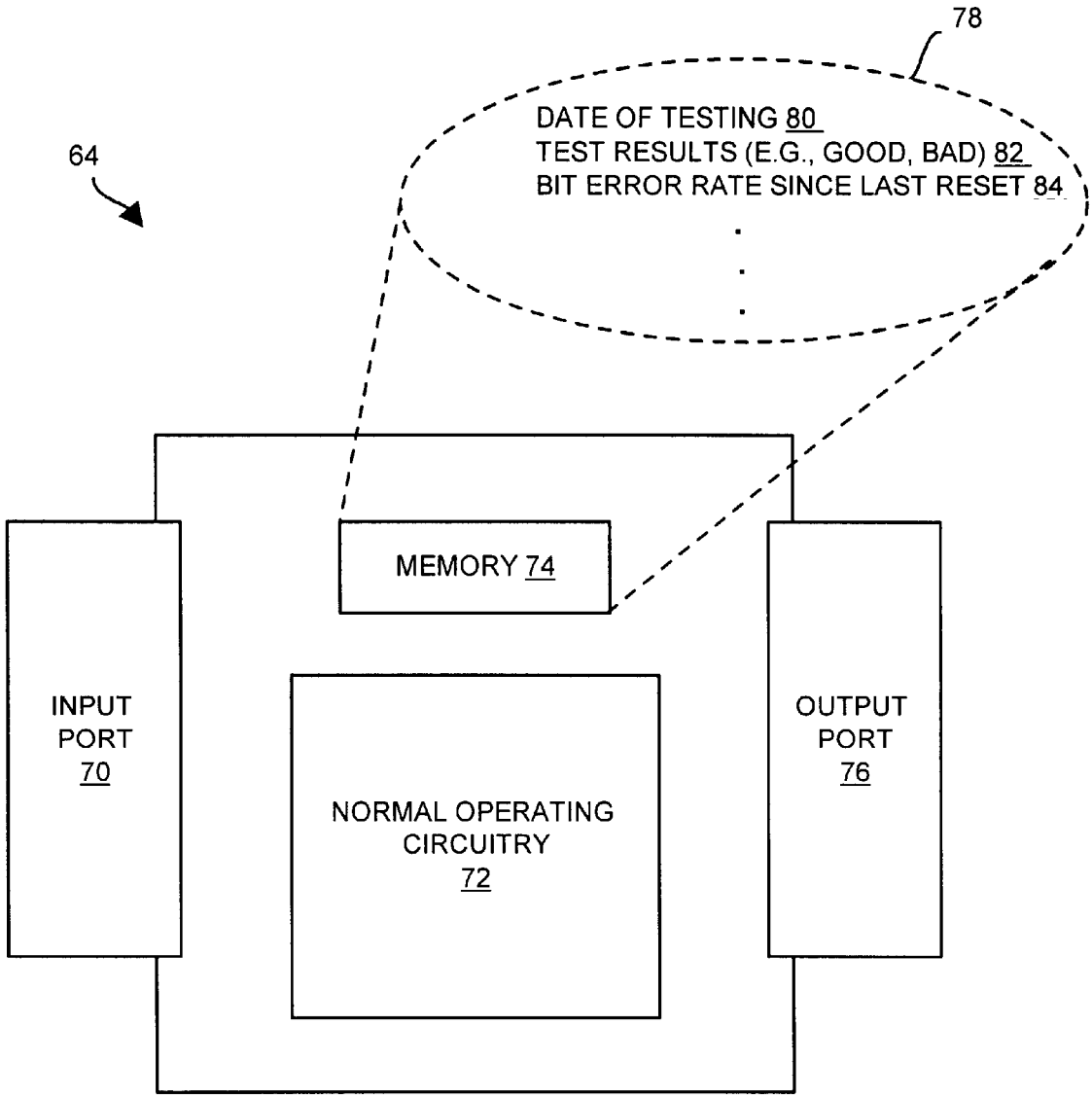
FIG. 4 is a block diagram of an electronic circuit of the electronic module of FIG. 2.

As shown in FIG. 4, the electronic circuit 64 includes an input port 70, normal operating circuitry 72, memory 74 and an output port 76. During normal operation, the input port 70 receives input signals from the circuit board 28 through the connectors 62, 30 (also see FIG. 3), and the output port 76 provides output signals to the circuit board 28 through the connectors 62, 30 based on operations performed within the normal operating circuitry 72. In one arrangement, the circuit board assembly 22 is an electrical-to-optical interface to the devices 24 (see FIG. 1), and the normal operating circuitry 72 performs electrical-to-optical conversion operations. The normal operating circuitry 72 has the capability to periodically update the contents of the memory 74 such that when the module 32 is removed from the circuit board connector 30 and installed on another assembly (e.g., a specialized module access assembly) contents 78 of the memory 74 can be retrieved and analyzed.

In one arrangement, the contents 78 of the memory 74 include the date 80 in which the module 32 was tested by the manufacturer, the results 82 of the test (e.g., good/bad, a transmission rating, etc.), and a bit error rate 84 (BER). In one arrangement, the manufacturer adds the date 80 and test results 82 to the module 32 prior to shipment. In contrast, the circuitry of the circuit board assembly 22 (e.g., the normal operating circuitry 72 of the module 32) dynamically adds or updates the bit error rate 84, i.e., the number of errors encountered while operating at a particular speed, once the module 32 is installed on the circuit board 28, and after a period of operation. In one arrangement, the module 32 has the ability to reset the bit error rate 84 such that the module 32 can be reused in another environment to store new data. In one arrangement, the contents 78 of the memory 74 are encrypted for improved security against tampering. Accordingly, the manufacturer can determine whether someone other than the manufacturer has tampered (e.g., attempted to hot swap the module 32) with the contents 78 of the memory 74. It should be understood that the data in the memory 74 can be written and read while the module 32 is attached to the circuit board connector 30, and include other information as well. Further details of the operation of the latch mechanism 42 will now be provided with reference to FIGS. 5 and 3.

Figure 5:
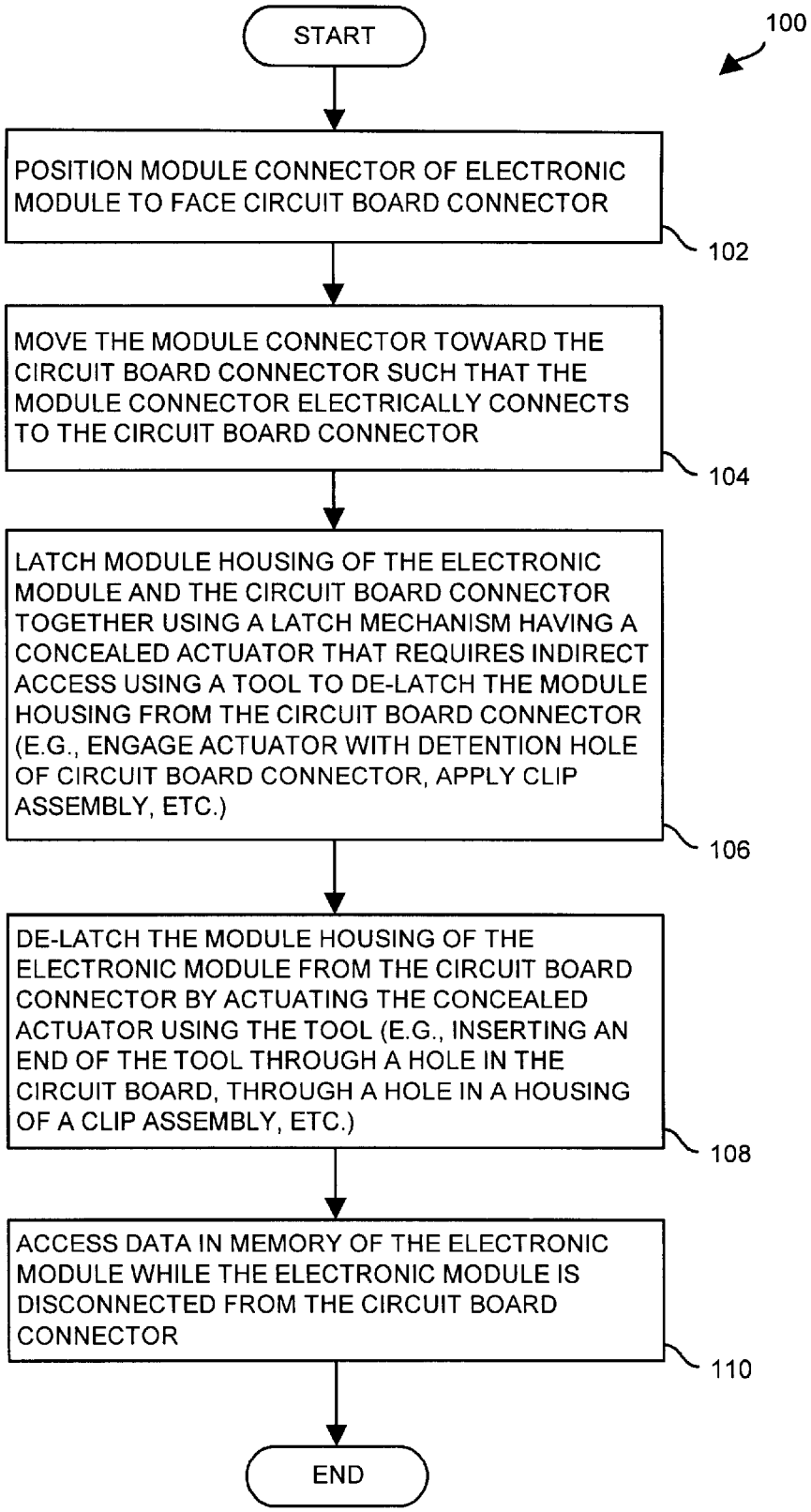
FIG. 5 is a flow diagram of a procedure which is performed by a user when controlling attachment of the electronic module to the circuit board connector of the connection system of FIG. 1.

FIG. 5 shows a procedure 100 which is performed by a user to install the module 32 within the circuit board connector 30, and later remove the module 32 from the circuit board connector 30. In step 102, the user positions the module connector 62 of the module 32 such that it faces the circuit board connector 30 (also see FIG. 3).

In step 104, the user moves the module connector 62 toward the circuit board connector 30 such that the module connector 62 electrically connects to the circuit board connector 30. In particular, the user inserts the module 32 into the cavity 54 of the circuit board connector 30 in the direction of the arrow 90. As the user inserts the module 32, the user compresses the actuator 44 toward the bottom-side surface 46 of the module 32. That is, the user moves the tabbed portion 50 of the actuator 44 in the direction of the arrow 92 (e.g., using a thumb, or forefinger, etc.) such that the tabbed portion 50 does not prevent further insertion of the module 32 within the circuit board connector 30. As the module 32 moves further into the cavity 54 of the circuit board connector 30, the module connector 62 of the module 32 makes electrical contact with the connection region 56 of the circuit board connector 30.

In step 106, the user latches the module housing 40 of the module 32 and the circuit board connector 30 together using the latch mechanism 42. In particular, as the module 32 enters its final connected position, the compressed actuator 44 decompresses when the tabbed portion 50 aligns with the hole 58 defined by the circuit board connector 30 (i.e., the tabbed portion 50 moves in the direction opposite the arrow 92 and into the hole 58). Accordingly, the module 32 is now in electrical communication with the rest of the circuit board 28 and retained within the circuit board connector 30 by the latch mechanism 42. The actuator 44 is concealed by the circuit board 28 and the circuit board connector 30, and requires indirect access using the tool 34 to de-latch the module housing 40 from the circuit board connector 30.

The module 32 is now ready for operation. Accordingly, the user can apply power to the circuit board assembly 22 and operate the electronic circuit 64 within the module housing 40 (also see FIG. 4). People without access to the tool 34 (e.g., the customer) will perceive de-latching the module 32 from the circuit board 28 to be a difficult task with a high risk of damaging the circuit board assembly 22 (e.g., damaging the circuit board connector 30, the module 32, etc.) without the use of the tool 34. Accordingly, those without the tool 34 will be deterred from tampering with the circuit board assembly 22.

In step 108, the user removes the module 32 from the circuit board assembly 22. That is, the user de-latches the module housing 40 from the circuit board connector 30 using the tool 34. In particular, the user actuates the actuator 44 by inserting the end of the actuating portion 38 of the tool 34 through the holes 60 and 58 (see arrow 94 in FIG. 3). The tabbed portion 50 of the actuator 44 compresses enough (see arrow 92) to clear the edge of the circuit board connector 30 at the hole 58. The user then slides the module 32 from the cavity 54 in the opposite direction of the arrow 90 to remove the module 32 from the circuit board connector 30.

In step 110, the user accesses the data within the memory 74 of the module 32 while the module 32 is disconnected from the circuit board connector 30. In one arrangement, the memory 74 is non-volatile, and the user installs the module 32 onto a separate assembly (e.g., another circuit board assembly, a custom assembly, etc.) in order to access the contents 78 of the memory 74 (also see FIG. 4).

It should be understood that the latching of the module 32 to the circuit board connector 30, such that the use of the tool 34 is required to de-latch the module 32, provides a deterrent to those without the tool 34 from tampering with the circuit board assembly 22. That is, rather than risk damaging the circuit board assembly 22 or one of its components (e.g., the circuit board connector 30, the module 32, etc.), a customer lacking the tool 34 will prefer to call a trained service provider in possession of the tool 34 (e.g., the manufacturer, a skilled technician working under a formal service contract, etc.) to service the circuit board 28 (e.g., to upgrade, reconfigure or otherwise modify the circuit board assembly 22). An alternative arrangement to that shown in FIGS. 2 and 3 will now be described with reference to FIGS. 6, 7, 8A and 8B.

Figure 6:
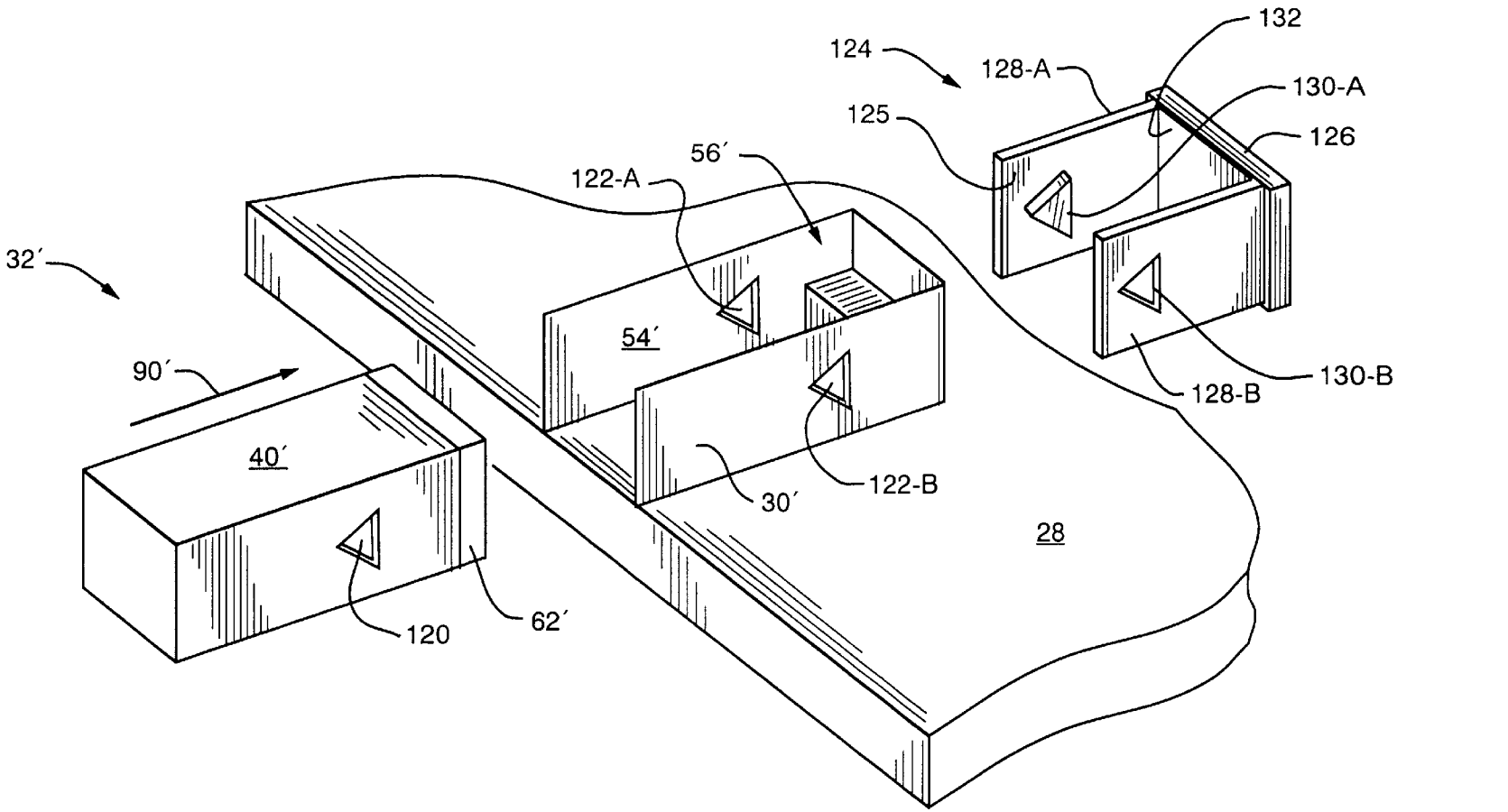
FIG. 6 is a perspective view of an alternative clip-assembly arrangement for the electronic module and the circuit board connector of FIG. 1.

FIG. 6 shows an alternative arrangement for the circuit board assembly 22 of FIG. 1, which is suitable for use by the invention. The arrangement of FIG. 6 includes a module 32' which connects to a circuit board connector 30' mounted on the circuit board 28. The module 32' includes a module housing 40' and a module connector 62'. The module housing 40' houses an electronic circuit such as that shown in FIG. 4 (not shown in FIG. 6 for simplicity). The module housing 40' defines orifices 120 on opposite sides for use by a latching mechanism.

As further shown in FIG. 6, the circuit board connector 30' includes a connecting region 56' (e.g., contacts, pins, pads, etc.) which mates with the module connector 62'. The circuit board connector 30' defines a cavity 54', and orifices 122-A and 122-B which align with the orifices 120 defined by the module housing 40' when the module 32' is installed within the circuit board connector 30'.

The arrangement of FIG. 6 further includes a clip assembly 124 which latches the circuit board connector 30' and the module 32' together. That is, the clip assembly 124 acts as a latch mechanism that controls attachment of the module 32' to the circuit board connector 30'. The clip assembly 124 includes a clip 125 and a clip housing 126 which, at least partially, conceals the clip 125. The clip 125 includes clip ends 128-A and 128-B. The clip end 128-A defines a tab 130-A, and the clip end 128-B similarly defines a tab 130-B.

The clip 125 is flexible. In particular, a force can be applied to the clip 125 to move the clip ends 128 (and the tabs 130) away from each other. When the force is removed, the clip ends 128 move toward each other and return to their initial positions relative to each other.

Figure 7:
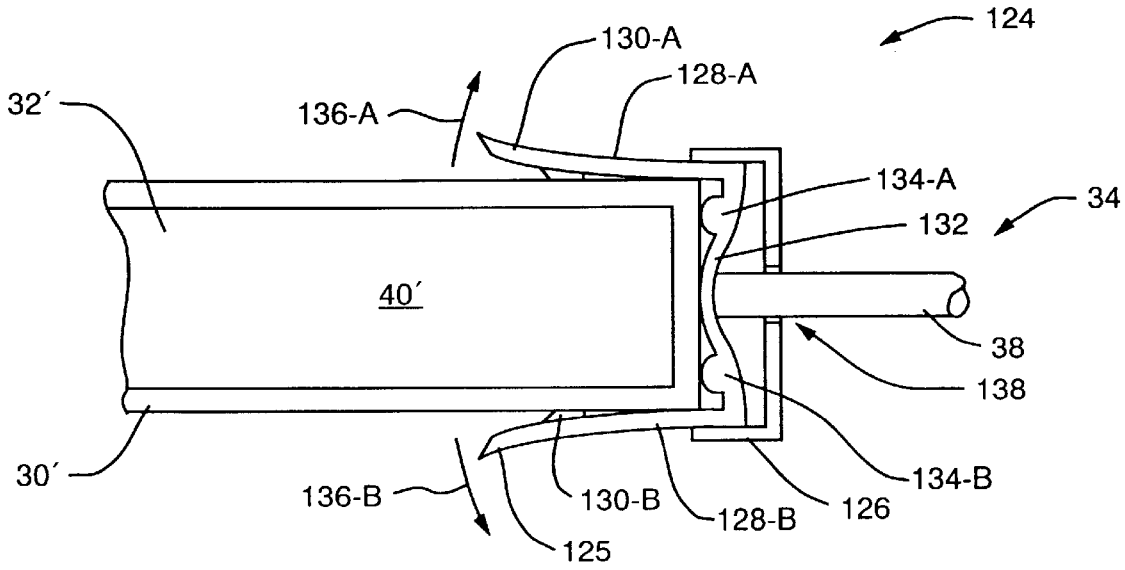
FIG. 7 is a top view of the alternative arrangement of FIG. 6 when the electronic module is de-latched from the circuit board connector by a de-latching tool.

FIG. 7 shows the clip assembly 124 applied around the circuit board connector 30' and the module housing 40' of the module 32'. To install the module 32' within the circuit board connector 30' (see steps 102 through 106 of FIG. 5), a user places the clip assembly 124 around the circuit board connector 30' and the module 32' to latch the module 32' to the circuit board connector 30' (step 106). The tabs 130 of the clip 125 extend through the circuit board orifices 122 into the module orifices 120. Accordingly, tabs 130 retain the module 32' within the circuit board connector 30'. The user can then apply power to the circuit board assembly 22 and operate the electronic circuit housed within the housing 40' of the module 32'.

The user can later de-latch the module 32' from the circuit board assembly 22. To this end, the user inserts the end of the actuation portion 38 of the tool 34 through a hole 138 defined in the clip housing 126 to bend the clip 125. In response, the clip 125 bends around pivoting members 134-A and 134-B of the clip 125 such that the clip ends 128-A, 128-B move in the directions of the arrows 136-A, 136-B. The pivoting members 134 provide cantilever action for the clip ends 128 in response to actuation force from the tool 34. Accordingly, the tabs 130 move out of the orifices 122, 120 (also see FIG. 6) thus enabling the user to remove the module 32' from the circuit board connector 30' (step 108 of FIG. 5). The user can then access the contents 78 of the memory 74 within the module 32' (step 110 of FIG. 5).

Figure 8A:
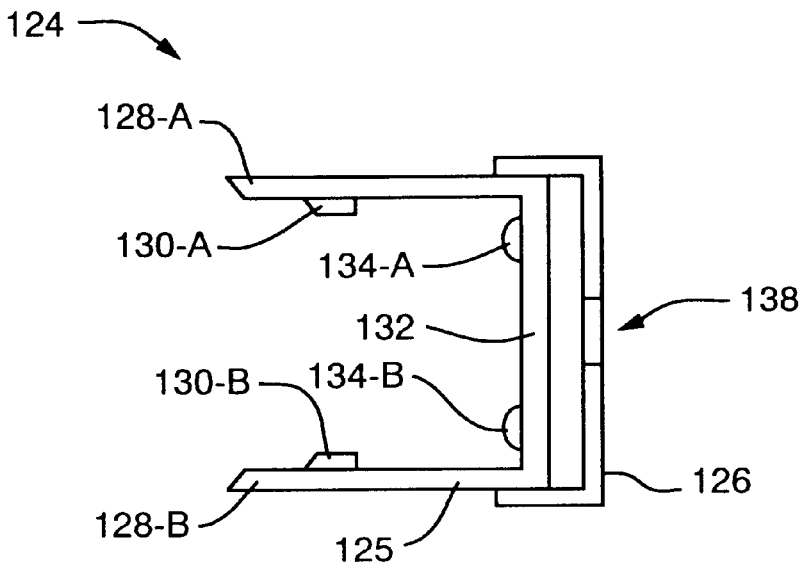
FIG. 8A is a top view of the clip assembly of FIG. 6.
Figure 8B:
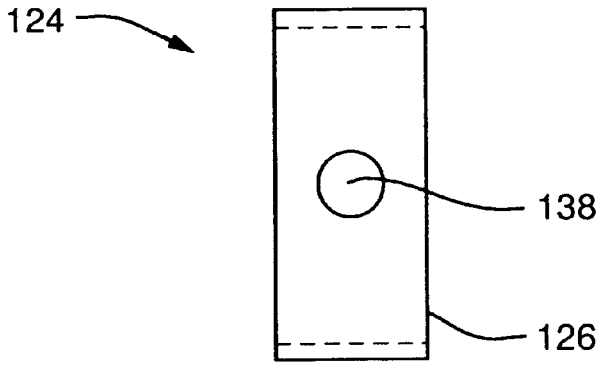
FIG. 8B is an end view of the clip assembly of FIG. 6.

FIG. 8A shows a top view of the clip assembly 124 when the clip 125 is in a non-flexed condition. FIG. 8B shows a side view of the clip assembly 124 when the clip 125 is in a non-flexed condition. It should be understood that the clip 125 is concealed, at least partially, by the clip housing 126 making it difficult for someone to remove the clip assembly 124 from its installed position around the circuit board connector 30' and the module 32' without the use of the tool 34 (i.e., to de-latch the module 32' from the circuit board connector 32'). Accordingly, when the clip assembly 124 latches the circuit board connector 30' and the module 32' together, people without access to the tool 34 are deterred from tampering with the module 32' and the circuit board connector 30'.

It should be understood that the module 32' and the circuit board connector 30' can be used together without the clip assembly 124. That is, a user can install (e.g., plug-in) the module 32' within the circuit board connector 30' without applying the clip assembly 124. In such a situation, the user can power up the circuit board 28 and operate the electronic circuit 64 within the module 32' in a normal fashion. However, since the clip assembly 124 is not in place, users are not deterred from removing module 32' from the circuit board connector 30' (e.g., to reconfigure the circuit board 28, to attempt to upgrade the circuit board without permission from the manufacturer or service providing company, etc.). Accordingly, this situation is more susceptible to non-authorized user tampering and possible problems (e.g., operating difficulties) than when using the clip assembly 124. Nevertheless, the arrangement of FIGS. 6, 7, 8A and 8B enables selective control over module tampering. Manufacturers of modules 32 and circuit board connectors 30 may be more inclined to make modules and connectors which are compatible with this arrangement (i.e., which have the same form factor) since such open access (i.e., use of the modules 32 and the connectors 30 without the clip assembly 124) tends to promote or increase use and popularity of these components among component purchasers.

As described above, the invention is directed to techniques for controlling attachment of an electronic module (e.g., an IC) with a circuit board assembly using a latching mechanism that requires a tool to de-latch the electronic module. As such, manufacturers can remove electronic modules from circuit board assemblies at customer sites, and prevent customers from removing the electronic modules themselves. Those without the tool 34 (e.g., customers) are deterred from de-latching the module from the circuit board assembly, i.e., from removing the module and/or reconfiguring the circuit board assembly. Accordingly, the invention permits a manufacture to make circuit boards having different configurations based on which types of modules (e.g., modules 32 and 32') are attached to the circuit boards, and worry less that customers without the tool 34 will be tampering with their circuit board assemblies (e.g., removing or replacing modules). Technicians responding to a service call at the customer site may be able to avoid having to order a new circuit board assembly and re-visit the customer site by simply stocking an extra module 32 and replacing an existing module 32 with the extra module 32 during the initial visit to the customer site.

The features of the invention, as described above, may be employed in computer systems, devices and methods such as those manufactured by EMC Corporation of Hopkinton, Mass.

While this invention has been particularly shown and described with references to preferred embodiments thereof, it will be understood by those skilled in the art that various changes in form and details may be made therein without departing from the spirit and scope of the invention as defined by the appended claims.

For example, it should be understood that there are the latch mechanisms other than those described above which are suitable for use by the invention. In one arrangement, the connection system 20 of FIG. 1 uses a latch mechanism similar to those employed by clothing retailers which lock, onto clothing merchandise, an electronic garment tag which is easily removed by a special apparatus having a curved actuator arm, but which is otherwise extremely difficult to remove.

Additionally, it should be understood that the electronic circuit 64 of FIG. 4 is shown by way of example only. Other electronic circuits are suitable for use by the invention. In particular, such electronic circuits do not need an input port 70 or an output port 76 as shown in FIG. 4. Moreover, it is not necessary for the electronic circuit 64 to include the memory 74 for storing the contents 78. These alternative electronic circuits are intended to be included as part of the invention.

Furthermore, it should be understood that connector geometries other than those shown in the figures are suitable for use by the invention. For example, the module connector 62 of the module 32 (see FIG. 3) can be located on the bottom-side surface 46 rather than an end. Similarly, the connecting region 56 of the circuit board connector 30 can be positioned along the connector-side which is flush with the circuit board 28 rather than at one end. Other connection arrangements are suitable for use by the invention as well.

Additionally, it should be understood that the "through-the-board" arrangement of FIG. 3 and the "from-the-back" arrangement of FIG. 7 both require the user to apply the tool 34 from awkward directions. This deters a non-authorized user without the tool 34 from attempting to de-latch modules 32 particularly while the circuit board 28 is power up (i.e., hot swap modules 32) since it is unlikely that the user will be able to maneuver a hand (or tool for that matter) around the circuit board assembly 22 while the circuit board assembly 22 is installed within a cabinet and powered up (e.g., while the circuit board assembly 22 rests within a card cage among other neighboring circuit board assemblies 22. Accordingly, with the use of the invention, the manufacturer can avoid problems (e.g., errors, damage, etc.) causes by customers attempting to tamper with the circuit board 28 while the connection system 20 is running.

Furthermore, it should be understood that the circuit board assembly 22 was described as an interface device by way of example only. The circuit board assembly 22 can perform other functions as well (e.g., operate as a processor, memory board, memory controller, etc.). Such differing applications are intended to be within the scope of the invention as well.

What is claimed is:

1. A method for controlling attachment of an electronic module with a circuit board connector mounted on a circuit board, the electronic module having (i) a module housing, (ii) a module connector and (iii) an electronic circuit which is housed within the module housing and which is electrically coupled to the module connector, the method comprising the steps of:

positioning the module connector of the electronic module to face the circuit board connector;

moving the module connector toward the circuit board connector such that the module connector electrically connects to the circuit board connector; and latching the module housing of the electronic module and the circuit board connector together using a latch mechanism having a concealed actuator that requires indirect access using a tool to de-latch the module housing from the circuit board connector.

2. The method of claim 1 wherein the circuit board defines a hole, and wherein the method further comprises the step of:

inserting the tool through the hole defined by the circuit board to actuate the concealed actuator such that the module housing de-latches from the circuit board connector.

3. The method of claim 1 wherein the electronic circuit of the electronic module includes memory which stores data defining operation of the electronic module while the electronic module is attached to the circuit board connector, and wherein the method further comprises the step of:

de-latching the electronic module from the circuit board connector to access the data stored in the memory while the electronic module is disconnected from the circuit board connector.

4. The method of claim 1, further comprising the step of:

moving the concealed actuator in a direction that is toward the module housing to de-latch the module housing from the circuit board connector.

5. The method of claim 1 wherein the step of latching includes the step of:

applying, as the latch mechanism, a clip assembly around at least a portion of the module housing and at least a portion of the circuit board connector to latch the module housing and the circuit board connector together.

6. The method of claim 5 wherein the clip assembly includes a clip, as the concealed actuator, and a clip housing which covers a portion of the clip and which defines a hole, and wherein the method further includes the step of:

inserting the tool through the hole defined by the clip housing to actuate the clip such that the module housing de-latches from the circuit board connector.

7. The method of claim 1, further comprising the step of:

depressing the concealed actuator using the tool to de-latch the module housing from the circuit board connector.

8. The method of claim 7 wherein the step of depressing the concealed actuator using the tool includes the step of:

moving the tool in a direction that is toward the module housing to move the concealed actuator toward the module housing.

9. A circuit board assembly, comprising:

a circuit board;

a circuit board connector mounded on the circuit board; and an electronic module having (i) a module housing, (ii) a module connector and (iii) an electronic circuit which is housed within the module housing and which is electrically coupled to the module connector, the electronic module being configured to attach to the circuit board connector when:

the module connector of the electronic module is positioned to face the circuit board connector;

the module connector is moved toward the circuit board connector such that the module connector electrically connects to the circuit board connector; and the module housing of the electronic module and the circuit board connector are latched together using a latch mechanism having a concealed actuator that requires indirect access using a tool to de-latch the module housing from the circuit board connector.

10. The circuit board assembly of claim 9 wherein a portion of one of the circuit board connector and the housing of the electronic module form the latch mechanism, wherein the circuit board defines a hole, and wherein the electronic module is further configured to:

de-latch from the circuit board connector when the tool is inserted through the hole defined by the circuit board to actuate the concealed actuator.

11. The circuit board assembly of claim 9 wherein the electronic circuit of the electronic module includes memory which stores data defining operation of the electronic module while the electronic module is attached to the circuit board connector such that (i) the electronic module can be de-latched from the circuit board connector and (ii) the data stored in the memory can be accessed while the electronic module is disconnected from the circuit board connector.

12. The circuit board assembly of claim 9 wherein the concealed actuator is configured to:

move in a direction that is toward the module housing to de-latch the module housing from the circuit board connector.

13. The circuit board assembly of claim 9, further comprising:

a clip assembly, as the latch mechanism, that applies around at least a portion of the module housing and at least a portion of the circuit board connector to latch the module housing and the circuit board connector together.

14. The circuit board assembly of claim 13 wherein the clip assembly includes a clip, as the concealed actuator, and a clip housing which covers a portion of the clip and which defines a hole; and wherein the clip is configured to de-latch the electronic module from the circuit board connector when the tool is inserted through the hole defined by the clip housing to actuate the clip.

15. The circuit board assembly of claim 9 wherein the electronic module is configured to de-latch from the circuit board connector upon depression of the concealed actuator using the tool.

16. The circuit board assembly of claim 15 wherein the concealed actuator is configured to:

move toward the module housing when the tool (i) contacts the concealed actuator and (ii) moves in a direction that is toward the module housing.

17. An electronic module, comprising:

a module housing;

a module connector; and an electronic circuit housed within the module housing and electrically coupled to the module connector, the module housing being configured to attach the electronic module to a circuit board connector mounted on a circuit board when:

the module connector is positioned to face the circuit board connector, the module connector is moved toward the circuit board connector such that the module connector electrically connects to the circuit board connector, and the module housing of the electronic module and the circuit board connector are latched together using a latch mechanism having a concealed actuator that requires indirect access using a tool to de-latch the module housing from the circuit board connector.

18. The electronic module of claim 17 wherein the circuit board defines a hole, and wherein the module housing is further configured to:

de-latch the electronic module from the circuit board connector when the tool is inserted through the hole defined by the circuit board to actuate the concealed actuator.

19. The electronic module of claim 17 wherein the electronic circuit of the electronic module includes memory which stores data defining operation of the electronic module while the electronic module is attached to the circuit board connector such that (i) the electronic module can be de-latched from the circuit board connector and (ii) the data stored in the memory can be accessed while the electronic module is disconnected from the circuit board connector.

20. The electronic module of claim 17 wherein the concealed actuator is configured to:

move in a direction that is toward the module housing to de-latch the module housing from the circuit board connector.

21. The electronic module of claim 17 wherein the module housing is configured to latch with the circuit board connector when a clip assembly, as the latch mechanism, is applied around at least a portion of the module housing and at least a portion of the circuit board connector.

22. The electronic module of claim 21 wherein the clip assembly includes a clip, as the concealed actuator, and a clip housing which covers a portion of the clip and which defines a hole; and wherein the module housing is configured to de-latch from the circuit board connector when the tool is inserted through the hole defined by the clip housing to actuate the clip.

23. The electronic module of claim 17 wherein the module housing is configured to de-latch from the circuit board connector upon depression of the concealed actuator using the tool.

24. The electronic module of claim 23 wherein the concealed actuator is configured to:

move toward the module housing when the tool (i) contacts the concealed actuator and (ii) moves in a direction that is toward the module housing.

25. A connection system, comprising:

a de-latching tool; and a circuit board assembly that includes:

a circuit board;

a circuit board connector mounded on the circuit board, and an electronic module having (i) a module housing, (ii) a module connector and (iii) an electronic circuit which is housed within the module housing and which is electrically coupled to the module connector, the electronic module being configured to attach to the circuit board connector when:

the module connector of the electronic module is positioned to face the circuit board connector;

the module connector is moved toward the circuit board connector such that the module connector electrically connects to the circuit board connector; and the module housing of the electronic module and the circuit board connector are latched together using a latch mechanism having a concealed actuator that requires indirect access using the de-latching tool to de-latch the module housing from the circuit board connector.

26. The connection system of claim 25, further comprising:

a clip assembly which, as the latch mechanism, is applied around at least a portion of the module housing and at least a portion of the circuit board connector to latch the module housing of the electronic module with the circuit board connector, the clip assembly including:

a clip, as the concealed actuator, and a clip housing which covers a portion of the clip and which defines a hole, and wherein the module housing is configured to de-latch from the circuit board connector when the de-latching tool is inserted through the hole defined by the clip housing to actuate the clip.

27. The connection system of claim 25 wherein the concealed actuator is configured to:

move toward the module housing when the tool (i) contacts the concealed actuator and (ii) moves in a direction that is toward the module housing.

* * * * *